US006468048B1

(12) United States Patent
Burkholder et al.

(10) Patent No.: US 6,468,048 B1
(45) Date of Patent: Oct. 22, 2002

(54) PORTABLE AIR COMPRESSOR HAVING STABLE BASE AND TIE-DOWN POINTS

(75) Inventors: Robert F. Burkholder, Jackson, TN (US); Mark W. Wood, Jackson, TN (US); Crandall B. Barbour, Jackson, TN (US); Mike L. Davis, Jackson, TN (US); Fred M. Morgan, Jackson, TN (US); David W. Robenalt, Jackson, TN (US); Dave C. Smith, Jackson, TN (US)

(73) Assignee: DeVilbiss Air Power Company, Jackson, TN (US)

( * ) Notice: Subject to any disclaimer, the term of this patent is extended or adjusted under 35 U.S.C. 154(b) by 0 days.

(21) Appl. No.: 09/802,139

(22) Filed: Mar. 8, 2001

Related U.S. Application Data

(60) Provisional application No. 60/187,745, filed on Mar. 8, 2000.

(51) Int. Cl.[7] ..... F04B 53/00

(52) U.S. Cl. ..... 417/234; 248/128; 248/129

(58) Field of Search ..... 417/234; 248/128, 248/129, 145.6, 311.2; 137/376, 899.4, 565.1 A

(56) References Cited

U.S. PATENT DOCUMENTS

| | | | | | |
|---|---|---|---|---|---|
| 2,804,259 | A | * | 8/1957 | Ralston | 137/899.4 |
| D197,860 | S | * | 3/1964 | Winger | D15/9 |
| D273,493 | S | * | 4/1984 | Dudley | 417/234 |
| 4,768,930 | A | * | 9/1988 | Grime et al. | 417/362 |
| 5,030,067 | A | * | 7/1991 | Ushiota et al. | 417/234 |
| 5,054,740 | A | * | 10/1991 | Wheeler | 248/675 |
| 5,884,659 | A | * | 3/1999 | Prosser et al. | 137/587 |
| 6,004,103 | A | * | 12/1999 | Fisher et al. | 417/26 |
| 6,129,516 | A | * | 10/2000 | Wang | 417/36 |

FOREIGN PATENT DOCUMENTS

IT 0 320 579 A1 * 6/1989

* cited by examiner

*Primary Examiner*—Charles G. Freay
*Assistant Examiner*—John F Belena
(74) *Attorney, Agent, or Firm*—Suiter & Associates PC

(57) ABSTRACT

A portable air compressor of the type having a horizontal compressed air storage tank is disclosed wherein the air compressor includes a stable base having a width at least substantially equal to the diameter of the compressed air storage tank. The air compressor may further include tie-down points for securing the air compressor to a platform.

16 Claims, 5 Drawing Sheets

PORTABLE AIR COMPRESSOR HAVING STABLE BASE AND TIE-DOWN POINTS

CROSS-REFERENCE TO RELATED APPLICATIONS

The present application claims the benefit under 35 U.S.C. §119(e) of U.S. Provisional Application Ser. No. 60/187,745, filed Mar. 8, 2000. Said U.S. Provisional Application Ser. No. 60/187,745 is herein incorporated by reference in its entirety.

FIELD OF THE INVENTION

The present invention generally relates to the field of air compressors, and more particularly to a portable air compressor having a stable base and tie-down points.

BACKGROUND OF THE INVENTION

Air compressors are used to provide compressed air for operating air powered tools such as nailing tools, socket driving tools, material shaping tools, sanding tools, spray painting tools, inflation chucks, and the like. A popular type of air compressor comprises a compressor mounted to a horizontal compressed air storage tank. The compressed air storage tank further includes a wheel assembly consisting of a wheel mounted to each side of the tank by a wheel bracket. A handle assembly and base are mounted to the air supply tank opposite the wheel assembly. The wheel assembly and base support the air compressor allowing the air compressor to be transported by lifting on the handle assembly thereby raising the base from the surface on which the air compressor rests.

One long unresolved problem with such air compressors is that they tend to be top heavy due in part to the weight of the compressor above the compressed air storage tank. Further, as shown in FIG. 1, such air compressors 100 include a base 102 which has historically been made much narrower than the width of the compressed air storage tank 104 since the three point stance provided by the base 102 and wheel assembly 106 was sufficient to balance and provide stability to the air compressor 100 when used in normal consumer applications. However, when such air compressors 100 are utilized in more austere environments, such as at a construction site, where the air compressor 100 is much more likely to rest on rough or uneven ground, it has been discovered that excessive tension (such as a sharp pull or jerk) applied to an air hose coupled to the air compressor in a direction generally perpendicular to the side of the compressed air storage tank 104 can cause the air compressor 100 tip over as shown by arrow 108, possibly damaging the air compressor or injuring its user. Similarly, when such air compressors are loaded into a vehicle such as a pickup truck, or the like for transport, movement of the vehicle may cause the air compressor 100 to tip over possibly damaging the air compressor 100 and the vehicle. As a result, many users consider air compressors having such horizontal compressed air storage tanks less desirable for use in harsh environments than air compressors having other tank configurations.

Consequently, it is desirable to provide a portable air compressor of the type having a horizontal compressed air storage tank, wherein the air compressor includes a more stable base to prevent tipping of the air compressor. Further, it would be desirable to provide tie-down points for securing the air compressor to a vehicle for transport.

SUMMARY OF THE INVENTION

Accordingly, the present invention is directed to a portable air compressor of the type having a horizontal compressed air storage tank. In accordance with one aspect of the invention, the air compressor includes a more stable base to prevent tipping of the air compressor. In an exemplary embodiment, the base includes a lower portion suitable for contacting a surface for providing support to the air compressor, wherein the lower portion has a width at least substantially equal to the diameter of the horizontal compressed air storage tank.

In accordance with a second aspect of the invention, the portable air compressor includes a plurality of tie-down points for securing the air compressor to a platform such as a vehicle or the like. In an exemplary embodiment, the tie-down points are provided in brackets utilized for mounting wheel and handle assemblies to the compressed air storage tank.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
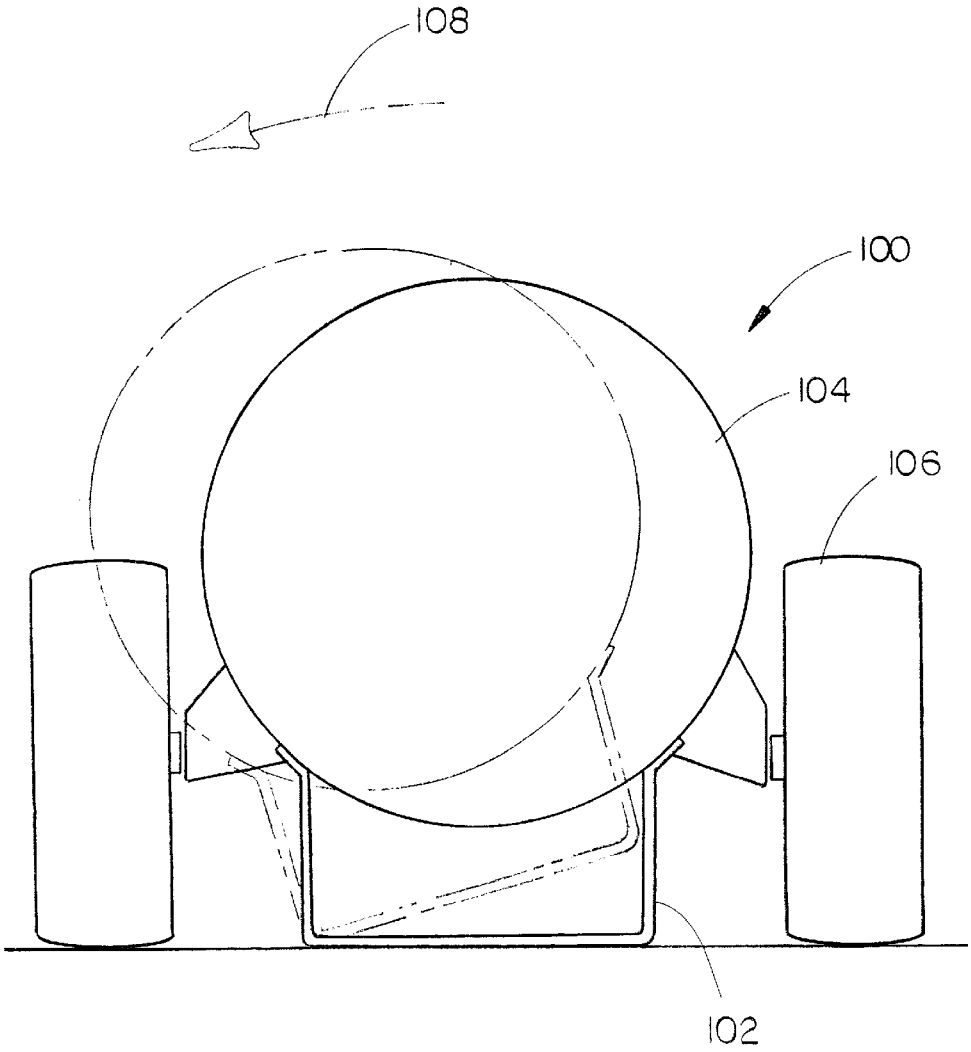
FIG. 1 (PRIOR ART)
FIG. 1 is an end elevational view of a portable air compressor having a narrow base.
Figure 2:
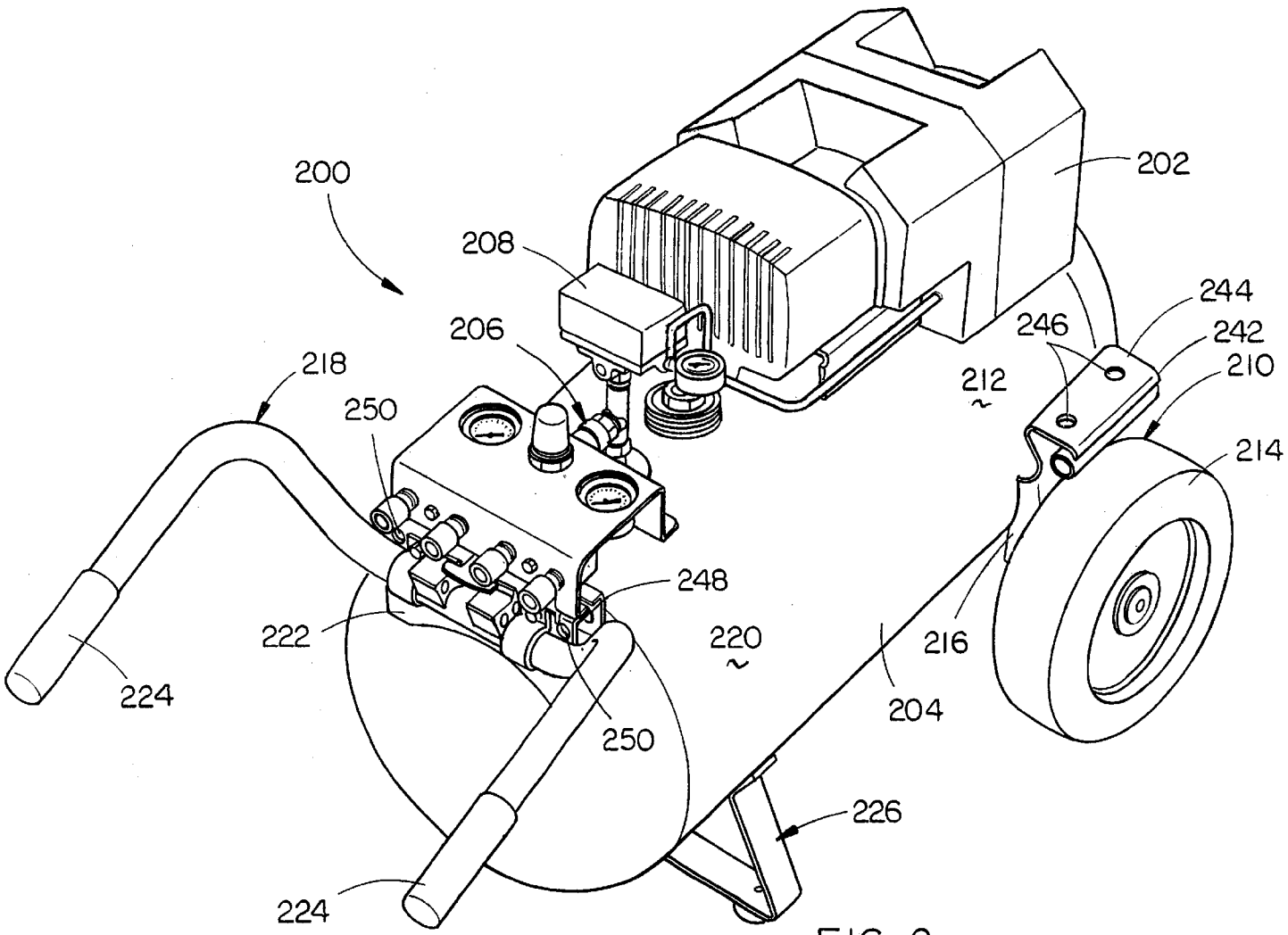
FIG. 2 is an isometric view illustrating a portable air compressor in accordance with an exemplary embodiment of the present invention.

Reference will now be made in detail to the presently preferred embodiments of the invention, examples of which are illustrated in the accompanying drawings.

Referring generally to FIGS. 2 through 5, a portable air compressor in accordance with an exemplary embodiment of the present invention is described. The portable air compressor 200 includes a compressor 202 mounted to a horizontal compressed air storage tank 204, often referred to in the art as a "hot-dog" style air tank. The compressed air storage tank 204 provides a reservoir or receiver for storing air under pressure. A pressure manifold assembly 206 is fitted to the compressed air storage tank 204 allowing compressed air to be drawn from the tank 204 for powering air powered tools such as nailing tools, socket driving tools, material shaping tools, sanding tools, spray painting tools, tire inflation chucks, and the like. In exemplary embodiments, a pressure switch assembly 208 is mounted to the pressure manifold assembly 206 for regulating pressure within the compressed air storage tank 204 by alternately starting and stopping the compressor 202 to periodically replenish the supply of air in the tank 204. Typically, when pressure within the tank 204 reaches a preset low pressure point, or "kick-in pressure", the pressure switch assembly 208 starts the compressor 202 to re-pressurize the tank 204. As the pressure within the tank 204 reaches a preset high pressure point, or "kick-out pressure", the pressure switch assembly 208 stops the compressor 202 to prevent over-pressurization of the tank 204. In this manner, the pressure of the compressed air in the compressed air storage tank 204 is maintained within a range generally suitable for powering one or more air powered tools.

The air compressor 200 further includes a wheel assembly 210 mounted to a first end portion 212 of the compressed air storage tank 204. In an exemplary embodiment, the wheel assembly 210 includes a wheel 214 mounted to each side of the air storage tank 204 by a wheel bracket 216. A handle assembly 218 is mounted to a second end portion 220 of the compressed air supply tank 204 opposite the wheel assembly 210 by a handle bracket 222. The handle assembly 218 allows the air compressor 200 to be transported by lifting upward on handles 224 and pushing the air compressor 200 much like a common wheelbarrow.

A base 226 is mounted to the bottom of the horizontal compressed air storage tank 204 adjacent to the second end portion 220, e.g., opposite the wheel assembly 210. In an exemplary embodiment, the base 226 includes a bottom member 228 and distal side members 230 & 232. Preferably, side members 230 & 232 are joined at the outer ends of bottom member 228 and extend upward therefrom. The side members 230 & 232 are terminated at their upper end by tank attachment members 234 & 236 which are angled to provide a surface for attachment of the base 226 to the bottom surface 238 of the horizontal compressed air storage tank 204 via a suitable attachment method such as welding, or the like. Feet 240, formed of plastic, rubber or like material, are attached to the bottom member 228. The feet 240 prevent the bottom member 228 from directly contacting floor surfaces on which the air compressor 200 may rest so that the base 226 does not damage (e.g., scratch, gouge, or mar) such surfaces.

In accordance with one aspect of the present invention, the lower portion of base 226, e.g., bottom member 228, has a width ("w") at least substantially as wide as the outer diameter of the compressed air storage tank 204. The base 226 thus provides increased resistance to tipping as a result of external forces exerted on the compressed air storage tank 204 or compressor 202, for example, by a user or vehicle inadvertently bumping into the side of the air compressor, by a user pulling or jerking an air hose coupled to the air compressor's pressure manifold assembly 206, or the like. In this manner, the base 226 provides increased stability to the air compressor 200, especially in austere environments.

Figure 3:
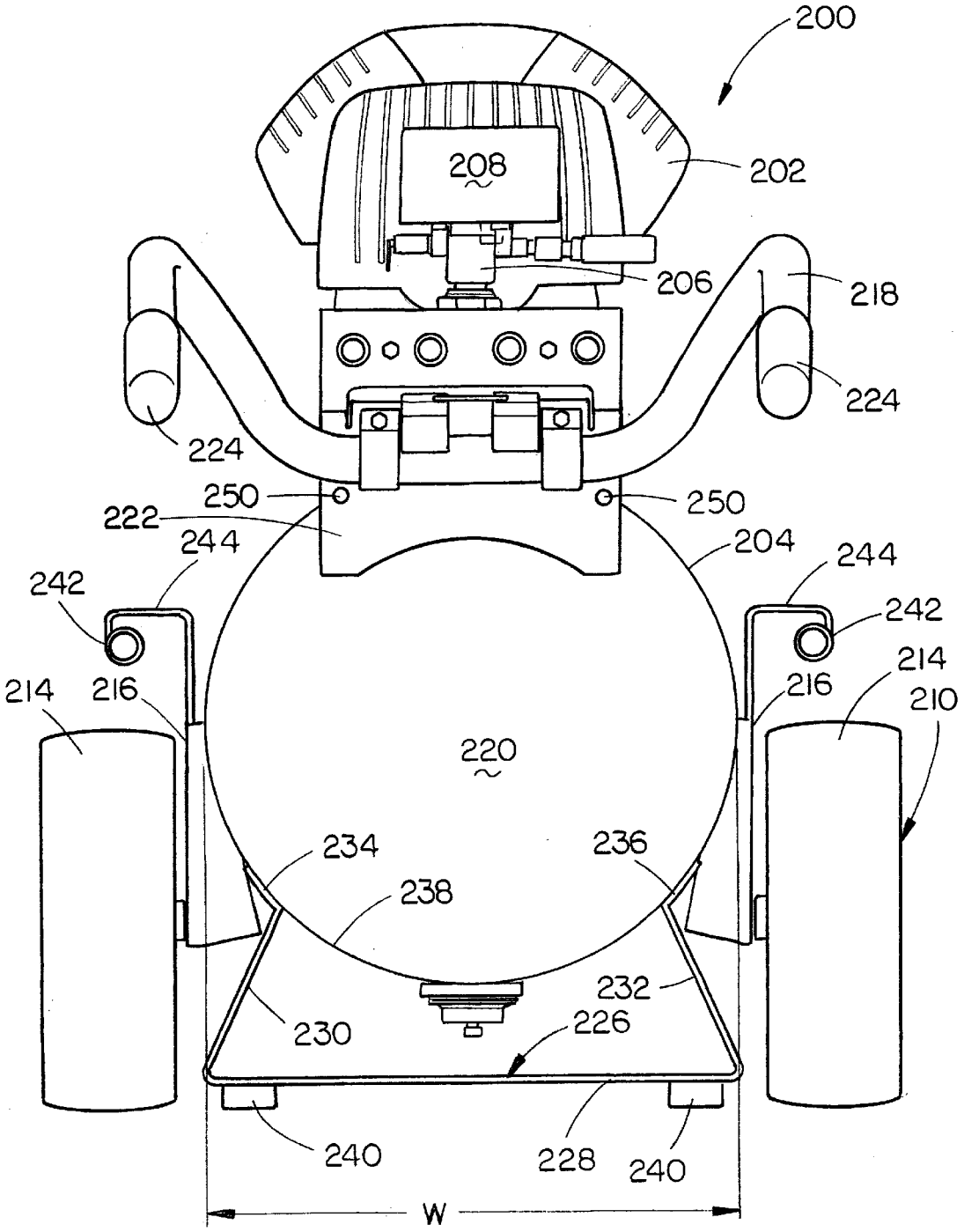
FIG. 3 is an end elevational view of the portable air compressor shown in FIG. 2.
Figure 4:
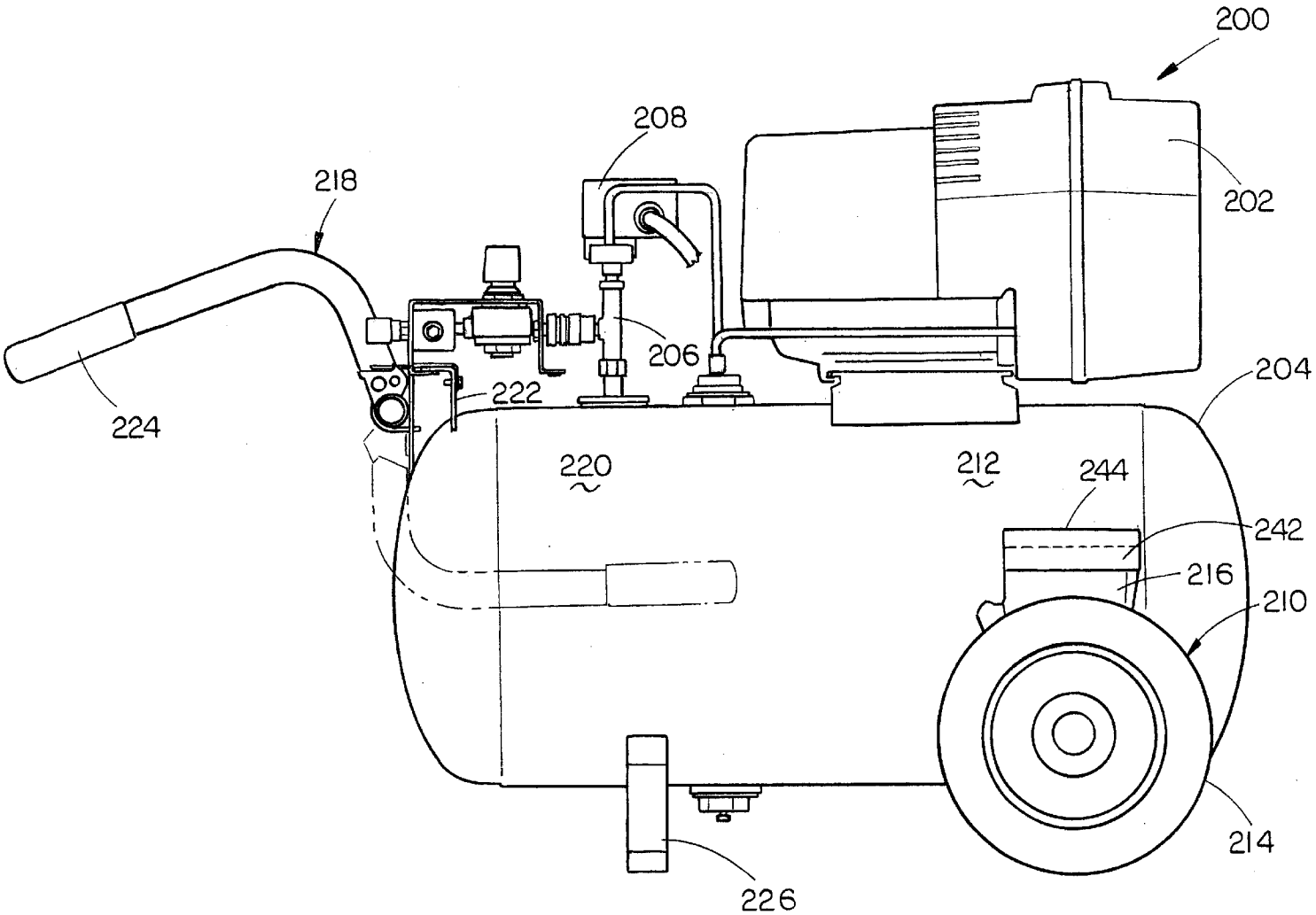
FIG. 4 is a side elevational view of the portable air compressor shown in FIG. 2.

As shown in FIG. 3, side members 230 & 232 may angle inwardly from the bottom member 228 so that attachment members 234 & 236 join the bottom surface of the compressed air storage tank 204. In this manner, the attachment between the base 226 and compressed air storage tank 204 is made more robust than would be possible if the side members 230 & 232 were attached to the sides of the tank 204 since the welds between the attachment members 234 & 236 and tank are subjected to lower shear stress. In the exemplary embodiment illustrated and described herein, the base 226 is shown as having a straight, single piece bottom member 228 and angled side members 230 and 232. However, it will be appreciated that the shape of base 226 is not limited to a specific geometry. For example, the base 226 may be provided with additional members extending between the bottom member 228 and the bottom surface 238 of the compressed air storage tank 204, or may be formed from a solid plate.

In accordance with a second aspect of the present invention, tie-down points may be provided for securing the air compressor 200 to a platform such as a floor surface, the bed and/or sidewalls of a truck, a trailer, a lift, or the like. In an exemplary embodiment, each wheel bracket 216 may include a handle assembly 242 providing a point by which a user may lift the air compressor 200. The handle assembly 242 includes an upper surface 244 having one or more apertures 246 formed therein. Similarly, the handle assembly mounting bracket 222 may include one or more additional apertures 248 & 250. Preferably, these apertures 246, 248 & 250 are sized to allow attachment of a rope, cable, cord, or the like thereby providing tide down points for securing the portable air compressor 200 to the platform.

Figure 5:
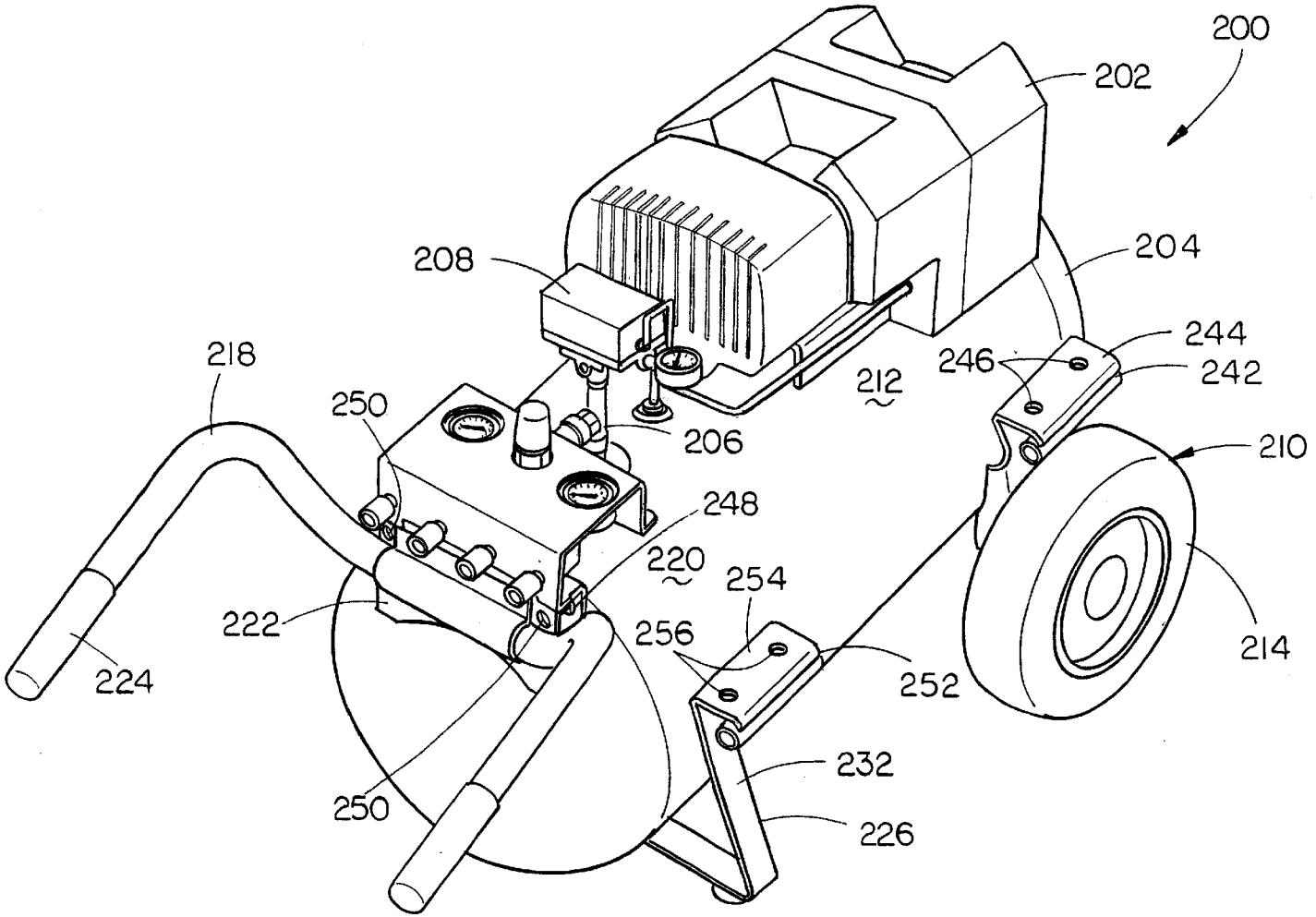
FIG. 5 is an isometric view illustrating a portable air compressor air tank assembly having a combination lift handle and stable support bracket in accordance with an exemplary embodiment of the present invention.

In a further embodiment shown in FIG. 5, the side members 230 & 232 of base 226 may be extended upward along the sides of the air storage tank 204 to support a second set of handle assemblies 252 which may be used in cooperation with handle assemblies 242 to lift the air compressor 200. Like the handle assemblies 242 provided by wheel brackets 216, handle assemblies 252 include an upper surface 254 having one or more apertures 256 formed therein providing additional tie-down points for the portable air compressor 200.

In view of the discussion of FIGS. 1 through 5, it will now be apparent to those of skill in the art that tie-down points may be provided elsewhere on the air compressor. For example, additional tie-down points may be furnished in brackets provided for mounting such components as the compressor 202, pressure manifold assembly 206, and pressure switch assembly 208. Accordingly, provision of such tie-down points by one of ordinary skill in the art would not depart from the scope and spirit of the present invention as defined in the appended claims.

It is believed that the portable air compressor of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A portable air compressor, comprising a horizontal compressed air storage tank suitable for storing compressed air, said horizontal compressed air storage tank having a tank diameter and including a first end portion and a second end portion;

a wheel assembly mounted to said compressed air storage tank adjacent to said first end portion for providing rolling support to said compressed air storage tank; said wheel assembly comprising at least one bracket suitable for mounting a wheel proximal to and on each side of said compressed air storage tank, said bracket including a handle suitable for use in lifting said portable air compressor; and a base mounted to said compressed air storage tank adjacent to said second end portion, said base having a lower portion suitable for contacting a surface to support said compressed air storage tank;

wherein the width of said base at said lower portion is at least substantially equal to the diameter of said horizontal compressed air storage tank.

2. The portable air compressor as claimed in claim 1, wherein said bracket further comprises at least one tie-down point suitable for securing said portable air compressor.

3. The portable air compressor as claimed in claim 1, wherein said base includes a handle for use in lifting said portable air compressor.

4. The portable air compressor as claimed in claim 1, wherein said base includes a support formed of a non-marring material.

5. The portable air compressor as claimed in claim 1, further comprising a transport handle assembly mounted to said first end portion, said transport handle assembly being suitable for use in transporting of said portable air compressor utilizing said wheel assembly.

6. The portable air compressor as claimed in claim 1, further comprising a compressor mounted to said air tank, said compressor being suitable for providing a source of compressed air for storage in said horizontal compressed air storage tank.

7. A portable air compressor, comprising:

a horizontal compressed air storage tank suitable for storing compressed air, said horizontal compressed air storage tank including a first end portion and a second end portion; and a wheel assembly mounted to said compressed air storage tank adjacent to said first end portion, said wheel assembly suitable for providing rolling support to said compressed air storage tank; and a base mounted to said compressed air storage tank adjacent to said second end portion, said base having a lower portion suitable for contacting a surface to support said compressed air storage tank, wherein said wheel assembly comprises at least one bracket suitable for mounting a wheel proximal to said compressed air storage tank, said bracket having at least one aperture formed therein for providing at least one tie-down point for securing said portable air compressor against unwanted movement.

8. The portable air compressor as claimed in claim 7, further comprising a transport handle assembly mounted to said second end portion, said transport handle assembly being suitable for use in transporting of said portable air compressor utilizing said wheel assembly.

9. The portable air compressor as claimed in claim 8, wherein said transport handle assembly includes a mounting bracket, said mounting bracket including at least one aperture for providing one of said at least one tie-down points.

10. The portable air compressor as claimed in claim 7, wherein the width of said base at said lower portion is at least substantially equal to the diameter of said horizontal compressed air storage tank.

11. The portable air compressor as claimed in claim 7, wherein said base includes a handle suitable for use in lifting said portable air compressor.

12. The portable air compressor as claimed in claim 11, said handle at least one aperture formed therein for providing one of said at least one tie-down points.

13. The portable air compressor as claimed in claim 7, wherein said base includes a support formed of a non-marring material.

14. The portable air compressor as claimed in claim 7, further comprising a compressor mounted to said horizontal compressed air storage tank, said compressor being 3 suitable for providing a source of compressed air for storage in said horizontal compressed 4 air storage tank.

15. A portable air compressor, comprising:

a horizontal compressed air storage tank suitable for storing compressed air, said horizontal compressed air storage tank having a tank diameter and including a first end portion and a second end portion;

means, mounted to said horizontal compressed air storage tank adjacent to said first end portion, for providing rolling support to said compressed air storage tank, said means for providing rolling support comprising means for supporting at least one wheel proximal to and on each side of said compressed air storage tank, said means for supporting at least one wheel proximal to and on each side of said compressed air storage tank including means for lifting said portable air compressor; and means, mounted to said horizontal compressed air storage tank adjacent to said second end portion, for supporting said compressed air storage tank, wherein the width of said supporting means is at least substantially equal to the diameter of said horizontal compressed air storage tank.

16. The portable air compressor as claimed in claim 15, further comprising means for securing said portable air compressor to a platform.

* * * * *